US006868842B2

(12) United States Patent
Strawbridge

(10) Patent No.: US 6,868,842 B2
(45) Date of Patent: Mar. 22, 2005

(54) CYLINDER HEAD OF ENGINE HAVING RECIRCULATION CHAMBER

(75) Inventor: Bryan E. Strawbridge, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/184,217

(22) Filed: Jun. 28, 2002

(65) Prior Publication Data

US 2004/0000297 A1 Jan. 1, 2004

(51) Int. Cl.[7] ..... F02M 25/07
(52) U.S. Cl. ..... 123/568.13
(58) Field of Search ..... 123/568.13, 568.11, 123/568.12, 193.5, 585, 48 AA, 316

(56) References Cited

U.S. PATENT DOCUMENTS 4,829,958 A * 5/1989 Duret ..... 123/316
4,934,346 A * 6/1990 Olson ..... 123/73 C
5,351,668 A * 10/1994 Gatellier ..... 123/568.13
5,782,226 A * 7/1998 Gartner ..... 123/568.13
6,102,014 A * 8/2000 Donaldson ..... 123/568.12
6,470,865 B2 * 10/2002 Iizuka et al. ..... 123/568.13
6,578,533 B1 * 6/2003 Gray, Jr. ..... 123/78 D

* cited by examiner

*Primary Examiner*—Tony M. Argenbright
*Assistant Examiner*—Hyder Ali
(74) *Attorney, Agent, or Firm*—Jason J Stanley

(57) ABSTRACT

A cylinder head of an engine has a body, at least one recirculation chamber, and a flow control system. The body defines at least one orifice, and the recirculation chamber is in fluid communication with the at least one orifice. The flow control system has an inlet flow position and an outlet flow position. A method of operating an engine having at least one recirculation chamber and at least one combustion chamber containing a pressurized fluid includes transferring a portion of the pressurized fluid from the at least one combustion chamber to the at least one recirculation chamber when the pressurized fluid reaches a first predetermined pressure value. The method also includes transferring the portion of the pressurized fluid from the at least one recirculation chamber to the at least one combustion chamber when the pressurized fluid in the at least one combustion chamber reaches a second predetermined pressure value.

23 Claims, 3 Drawing Sheets

CYLINDER HEAD OF ENGINE HAVING RECIRCULATION CHAMBER

TECHNICAL FIELD

This invention relates generally to a cylinder head for use with an internal combustion engine, and more particularly to a cylinder head configured to recirculate a portion of pressurized fluid from a combustion chamber of the engine.

BACKGROUND

In recent years internal combustion engine manufacturers have faced the challenge of increasing the power output of engines while also improving fuel economy and reducing emissions. One potential manner of meeting these challenges is the use of Homogeneous Charge Compression Ignition (HCCI) technology. Engines using HCCI technology combine some of the attributes of spark ignition (SI) engines and compression ignition (CI) engines. Like SI engines, the fuel and air within the cylinder is well mixed, which minimizes particulate emissions. Like CI engines, the fuel is ignited by compression, and the engine has no throttling losses, which leads to high efficiency.

A major challenge in the use of HCCI engines is handling the high pressures created within the combustion chamber by the compression of the fuel/air mixture prior to its combustion. These high pressures can place intense strain upon the cylinder head, cylinder liners, pistons and connecting rods of the engine. In addition, operating the engine at such high pressures may decrease the overall efficiency of the engine.

One manner of managing such high pressures within the combustion chamber involves the use of a bleed valve. When the pressure within the combustion chamber reaches a certain level, the bleed valve is opened and a portion of the fluid within the combustion chamber is permitted to exit the combustion chamber. The removal of a portion of the fluid in the combustion chamber reduces the pressure within the chamber. A disadvantage of this process, however, is that the energy of the fluid bled from the chamber is lost. One alternative process is to feed the bled fluid through a turbine of a turbocharger. In this manner, some of the energy in the fluid is used to increase the boost in the engine. However, there is a need for an engine that can capture more of the energy from the excess pressure within the combustion chamber. Such an engine would be beneficial for use not only with HCCI technology, but also in any other application in which excess pressure is produced within the combustion chamber.

SUMMARY OF THE INVENTION

A cylinder head of an engine has a body, at least one recirculation chamber, and a flow control system. The body defines at least one orifice, and the recirculation chamber is in fluid communication with the at least one orifice. The flow control system has an inlet flow position and an outlet flow position.

An engine has a cylinder head, at least one recirculation chamber, and a flow control system. The cylinder head has a body defining at least one orifice. The at least one recirculation chamber is in fluid communication with the at least one orifice. The flow control system has an inlet flow position and an outlet flow position.

An engine has a block, a cylinder head attached to the block, at least one piston, at least one combustion chamber, and means for recirculating a portion of pressurized fluid within the engine. The block has at least one cylinder bore containing a cylinder liner, and the at least one piston is slideably positioned within the cylinder liner. The cylinder head has a body. The at least one combustion chamber is defined by the body, the at least one piston, and the cylinder liner. The at least one combustion chamber contains a pressurized fluid. A portion of the pressurized fluid is transferred from the at least one combustion chamber when the pressurized fluid has a first predetermined pressure value, and the portion of pressurized fluid is transferred to the at least one combustion chamber when the pressurized fluid within the at least one combustion chamber is equal to a second predetermined pressure value.

A method of operating an engine having at least one recirculation chamber and at least one combustion chamber containing a pressurized fluid includes transferring a portion of the pressurized fluid from the at least one combustion chamber to the at least one recirculation chamber when the pressurized fluid reaches a first predetermined pressure value. The method also includes transferring the portion of the pressurized fluid from the at least one recirculation chamber to the at least one combustion chamber when the pressurized fluid in the at least one combustion chamber reaches a second predetermined pressure value.

DETAILED DESCRIPTION

Figure 1:
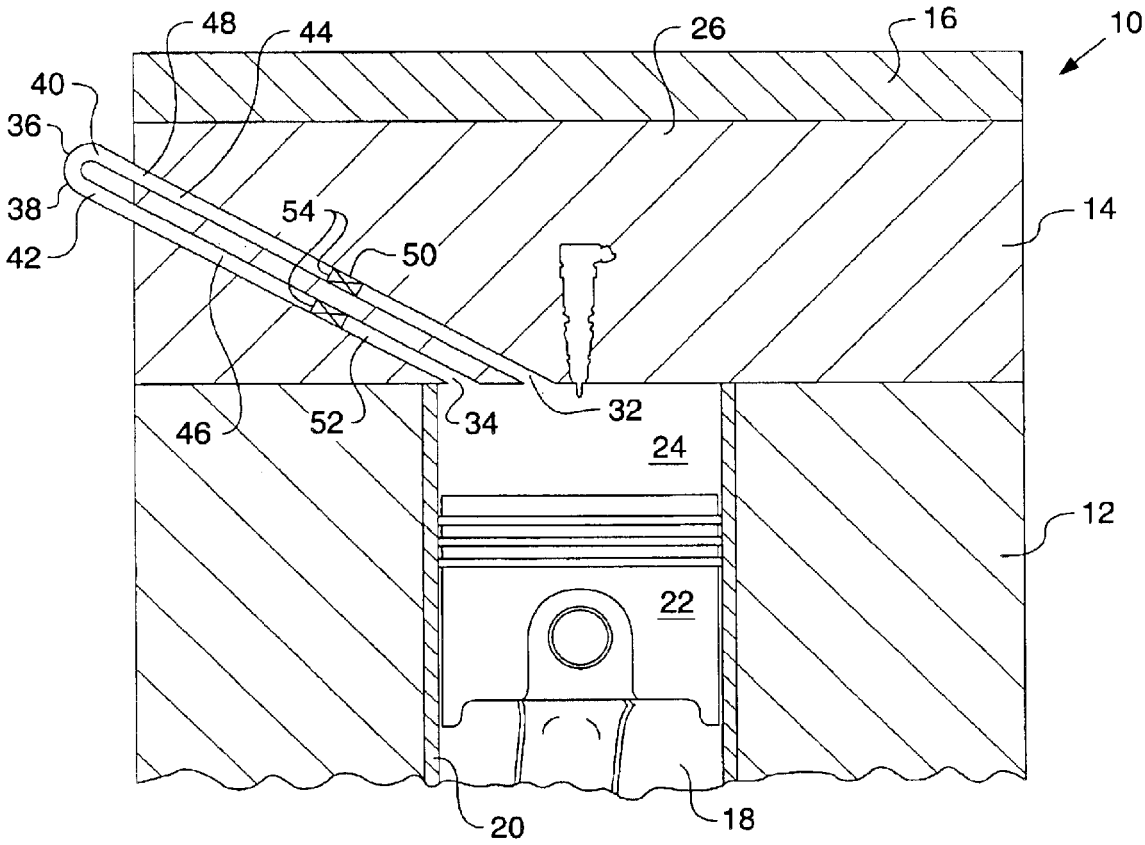
FIG. 1 is a cross-sectional view of an engine with a cylinder head having a recirculation chamber.

Referring to FIG. 1, an internal combustion engine 10 is shown. The engine 10 includes a cylinder block 12, a cylinder head 14 attached to the block 12, and a valve cover 16 attached to the cylinder head 14 in a conventional manner. The engine 10 also has an Electronic Control Module (ECM), not shown, connected to the engine 10. The cylinder block 12 defines a cylinder bore 18, in which a cylinder liner 20 is disposed. A piston 22 is slideably positioned within the cylinder liner 20. The piston 22 travels within the cylinder liner 20 between a top dead center position (TDC), i.e. the position closest to the cylinder head 14, and a bottom dead center position (BDC), i.e. the position furthest from the cylinder head 14. The piston 22, cylinder liner 20, and cylinder head 14 define a combustion chamber 24. In the embodiment of the engine 10 shown in FIG. 1, the cylinder block 12 has a single cylinder bore 18 and one piston 22. However, the cylinder block 12 may be of any other conventional design, such as "V" or radial, and may have any number of bores 18 and pistons 22 equally or unequally spaced.

Figure 2:
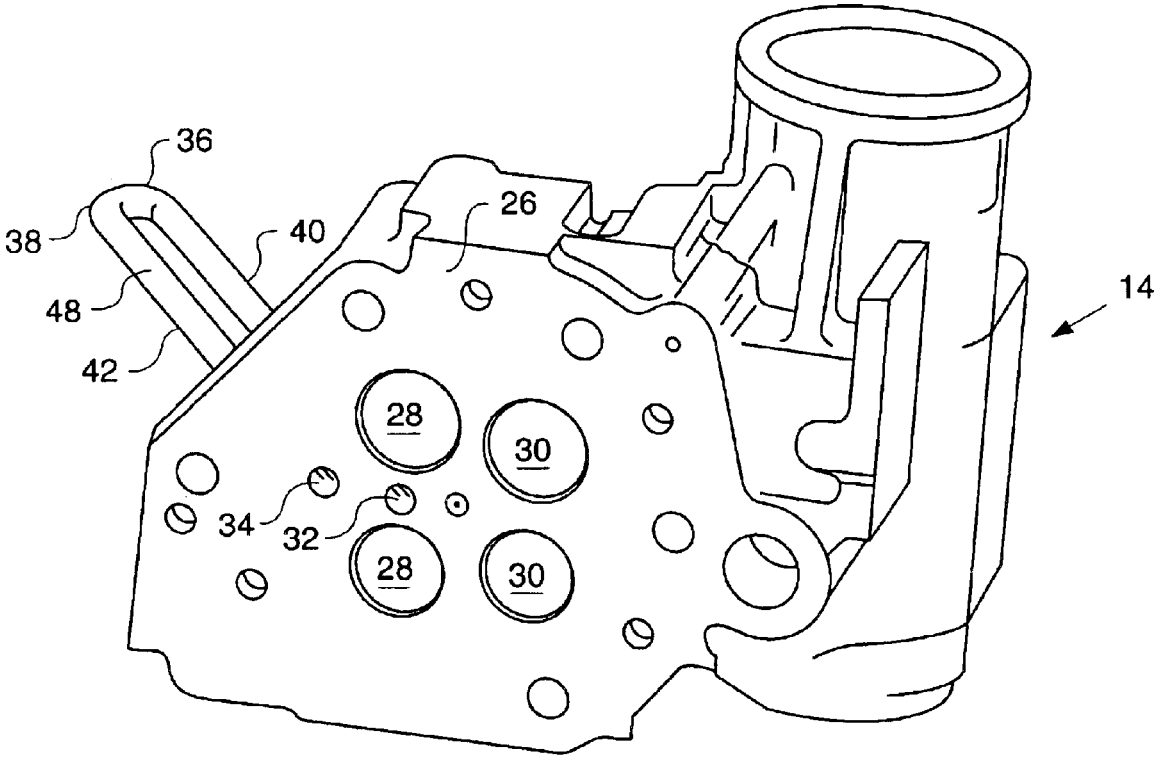
FIG. 2 is a perspective view of the cylinder head of FIG. 1.

The cylinder head 14 of the engine 10 has a body 26. Intake valves 28 and exhaust valves 30 are disposed within the body 26 of the cylinder head 14, as shown in FIG. 2. The body 26 also defines a first orifice 32 and a second orifice 34 therein. Referring again to FIG. 1, the first orifice 32 is in fluid communication with the combustion chamber 24, and the second orifice 34 is in fluid communication with the combustion chamber 24. The cylinder head 14 also has a tubular member 36 connected to the body 26 of the cylinder head 14 and positioned externally of the body 26 of the cylinder head 14. The tubular member 36 is defined by a wall 38, and the tubular member 36 has a first end portion 40 and a second end portion 42. The tubular member 36 contains a fluid, such as air or combustion gases. The cylinder head 14 has a first bore 44 and a second bore 46, the second bore 46 being spaced from the first bore 44. The first end portion 40 of the tubular member 36 is positioned such that the fluid in the tubular member 36 is in fluid communication with the first bore 44. The second end portion 42 of the tubular member 36 is positioned such that the fluid in the tubular member 36 is in fluid communication with the second bore 46. In the embodiment of FIG. 1, the tubular member 36, the first bore 44, and the second bore 46 define a recirculation chamber 48. The term "chamber," when used herein in the phrase "recirculation chamber," shall have the meaning set forth in Webster's II New College Dictionary: "an enclosed space or compartment: cavity."

A first flow control mechanism 50 is disposed within the first bore 44 and interposed the recirculation chamber 48 and the first orifice 32. The first flow control mechanism 50 has an inlet flow position and a closed position. When the first flow control mechanism 50 is in the inlet flow position, the recirculation chamber 48 is in fluid communication with the first orifice 32. A second flow control mechanism 52 is disposed within the second bore 46 and interposed the recirculation chamber 48 and the second orifice 34. The second flow control mechanism 52 has an outlet flow position and a closed position. When the second flow control mechanism 52 is in the outlet flow position, the recirculation chamber 48 is in fluid communication with the second orifice 34. The first flow control mechanism 50 and the second flow control mechanism 52 together form a flow control system 54 having the inlet flow position, the outlet flow position, and the closed position.

In the embodiment of the cylinder head 14 in FIG. 1, the recirculation chamber 48 has a defined volume. The connection between the tubular member 36 and the body 26 of the cylinder head 14 may be a fixed connection or a slideable connection. A slideable connection permits the first end portion 40 of the tubular member 36 to slide into and out of the first bore 44 and the second end portion 42 of the tubular member 36 to slide into and out of the second bore 46. Therefore, if the tubular member 36 has a slideable connection with the body 26 of the cylinder head 14, the tubular member 36 may have any of a plurality of volumes.

Figure 3:
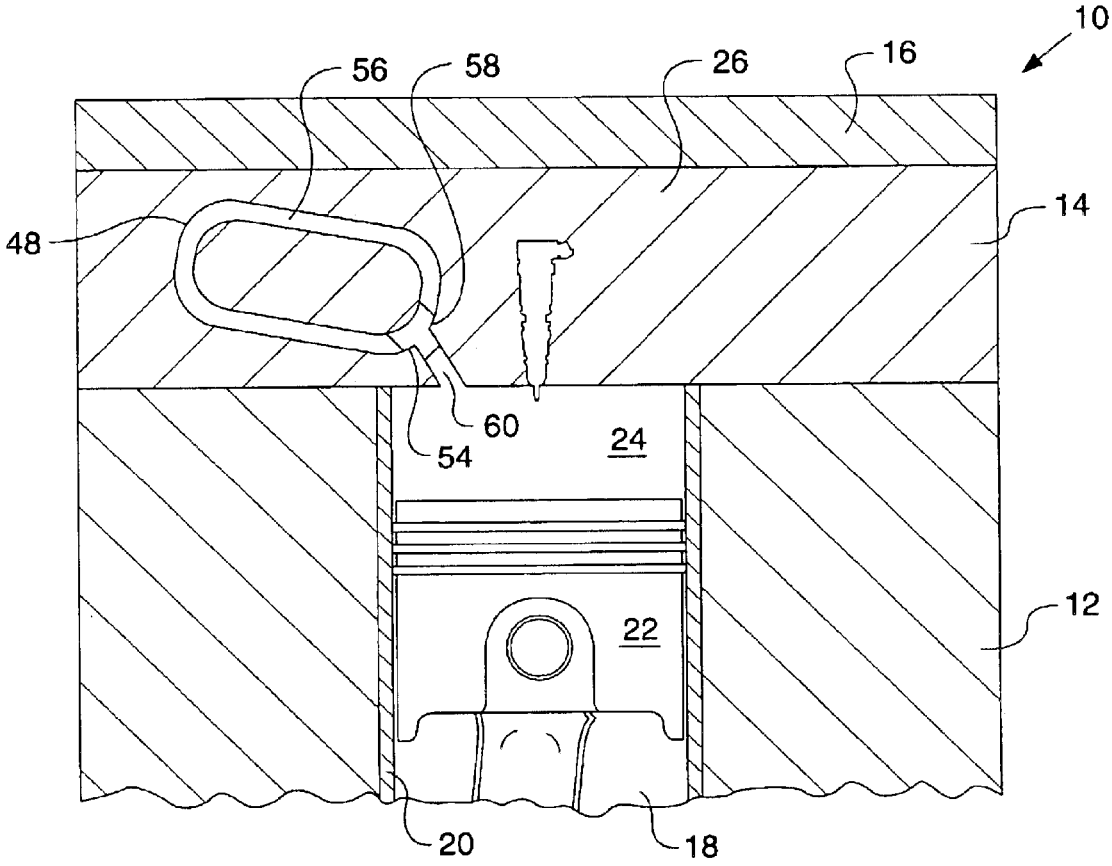
FIG. 3 is a cross-sectional view of another embodiment of an engine with a cylinder head having a recirculation chamber.

Another embodiment of the cylinder head 14 of the present invention is shown in FIG. 3. The recirculation chamber 48 in the cylinder head 14 is formed by a passage 56 that is completely contained within the cylinder head 14. A flow control mechanism 58 is disposed within the passage 56 and is interposed the recirculation chamber 48 and an orifice 60 in the head 14. The flow control mechanism 58 has an inlet flow position, a closed position, and an outlet flow position. When the flow control mechanism 58 is in either the inlet flow position or the outlet flow position the recirculation chamber 48 is in fluid communication with the orifice 60. Therefore, the flow control mechanism 58 alone forms a flow control system 54 having the inlet flow position, the outlet flow position and the closed position.

One of ordinary skill in the art will appreciate that the flow control system 54 of the cylinder head 14 in FIG. 1 may be used with the embodiment of the cylinder head 14 in FIG. 3. Likewise, the flow control system 54 of the cylinder head 14 in FIG. 3 may be used with the embodiment of the cylinder head 14 in FIG. 1. Any number, type, and configuration of flow control mechanisms may be used to produce a flow control system 54 having an inlet flow position and an outlet flow position, including check valves, two-way valves, three-way valves, ball valves, spool valves, gate valves, butterfly valves, and poppet valves. In addition, the cylinder head 14 may have any number of orifices connecting the recirculation chamber 48 with the combustion chamber 24 of the engine.

In an alternative embodiment of the cylinder head 14, the cylinder head 14 may have a recirculation chamber 48 that is in fluid communication with more than one combustion chamber 24 of the engine 10. Alternatively, the cylinder head 14 may have more than one recirculation chamber 48 in fluid communication with each combustion chamber 24 of the engine 10.

INDUSTRIAL APPLICABILITY

In the conventional operation of the engine 10, a fluid, such as air or a fuel/air mixture, is drawn, or blown via a turbocharger or supercharger, past the intake valves 28 into the combustion chamber 24 of the engine 10. As the fluid enters the combustion chamber 24, the piston 22 moves from TDC towards BDC. The piston 22 then moves from BDC towards TDC, thereby compressing the fluid and increasing the pressure within the combustion chamber 24.

When the pressure within the combustion chamber 24 reaches a first predetermined pressure value, the flow control system 54 is placed in the inlet flow position. A portion of the fluid in the combustion chamber 24 then is transferred from the combustion chamber 24 into the recirculation chamber 48. The fluid in the recirculation chamber 48 is stored in the recirculation chamber 48 while combustion occurs in the combustion chamber 24. The force of combustion drives the piston 22 towards BDC. As the piston 22 moves towards BDC, the pressure within the combustion chamber 24 decreases. Once the pressure within the combustion chamber 24 reaches a second predetermined pressure value, the flow control system 54 is placed in the outlet flow position and the fluid in the recirculation chamber 48 is transferred from the recirculation chamber 48 into the combustion chamber 24. All of the fluid in the recirculation chamber 48 or only a portion of the fluid in the recirculation chamber 48 may be transferred into the combustion chamber 24. The flow of fluid from the recirculation chamber 48 into the combustion chamber 24 acts on the piston 22 and provides additional force to move the piston 22 towards BDC.

The operation of the engine 10 continues with the piston 22 reaching BDC and then moving towards TDC. The movement of the piston 22 towards TDC forces products of the combustion process out of the combustion chamber 24 via the exhaust valves 30. The piston 22 then reaches TDC and the process begins again with the intake of fluid via the intake valves 28. Therefore, it can be understood from the above description that the flow control system 54 and the recirculation chamber 48 together provide a means for recirculating a portion of the pressurized fluid within the engine 10.

The first predetermined pressure value is at least as large as the second predetermined pressure value. Therefore, when the fluid is transferred from the recirculation chamber 48 to the combustion chamber 24, the fluid being transferred has a pressure that is equal to or greater than the pressure within the combustion chamber 24. The transfer of fluid from the recirculation chamber 48 into the combustion chamber 24 therefore either increases the pressure in the combustion chamber 24 or slows the rate of the pressure drop within the combustion chamber 24. In either situation, the force acting on the piston 22 to move it towards BDC is increased. Utilizing the pressure in the recirculated fluid to drive the piston 22 is a more efficient use of the energy in the fluid than using the fluid to drive a turbocharger, as discussed above. Therefore, the process of transferring fluid from the combustion chamber 24 into the recirculation chamber 48 and then transferring the fluid from the recirculation chamber 48 into the combustion chamber 24 increases the efficiency of the engine 10.

An alternative process may be used with the embodiment of the cylinder head 14 having the tubular member 36 slideably connected to the body 26 of the cylinder head 14. The volume of the recirculation chamber 48 may be modified at any point during the operation of the engine 10 by varying the positions of the first end portion 40 of the tubular member 36 and the second end portion 42 of the tubular member 36 with respect to the first bore 44 and the second bore 46 of the cylinder head 14, respectively. The ECM can determine the optimal volume of the recirculation chamber 48 based upon the operating conditions of the engine 10 and can adjust the volume of the recirculation chamber 48 accordingly.

The cylinder head 14 of the present invention may be used in any of several types of engines, including CI engines, SI engines, and HCCI engines. Also, although the discussion above of the operation of an engine 10 using the cylinder head 14 of the present invention described the operation of a four-cycle engine, one of ordinary skill in the art will recognize that a two-cycle engine may also benefit from the use of the cylinder head.

Other aspects, objects, and advantages of this invention can be obtained from a study of the drawings, the disclosure, and the appended claims.

What is claimed is:

1. A cylinder head comprising:

a body, said body configured to receive at least one intake valve, said body defining at least one orifice;

at least one recirculation chamber in fluid communication with said at least one orifice, said recirculation chamber spaced apart from said at least one intake valve;

and a flow control system, said flow control system having an inlet flow position and an outlet flow position, said flow control system interposed said at least one orifice and said at least one recirculation chamber.

2. The cylinder head of claim 1 wherein said flow control system has a flow control mechanism defining said inlet flow position, a closed position and said outlet flow position.

3. The cylinder head of claim 1 wherein said flow control system has a first flow control mechanism and a second flow control mechanism, said first flow control mechanism defining said inlet flow position and a closed position and said second flow control mechanism defining said outlet flow position and a closed position.

4. The cylinder head of claim 1 wherein said at least one recirculation chamber is located within said body of said cylinder head.

5. The cylinder head of claim 1 wherein at least a portion of said at least one recirculation chamber is positioned externally of said body of said cylinder head.

6. The cylinder head of claim 1 wherein said at least one recirculation chamber is bounded by at least one wall, said at least one wall being connected to said body of said cylinder head.

7. The cylinder head of claim 6 wherein said body has a first bore and a second bore, said second bore being spaced from said first bore;

said at least one wall defines a tubular member containing a fluid, said tubular member having a first end portion and a second end portion, said first end portion positioned such that said fluid is in fluid communication with said first bore, said second end portion positioned such that said fluid Is in fluid communication with said second bore;

said flow control system has a first flow control mechanism interposed said first orifice and said first end portion; and said flow control system has a second flow control mechanism interposed said second orifice and said second end portion.

8. The cylinder head of claim 1 wherein said at least one recirculation chamber has a plurality of volumes.

9. An engine, said engine comprising:

a cylinder head, said cylinder head having a body, said body having at least one orifice;

at least one recirculation chamber in fluid communication with said at least one orifice;

at least one intake valve disposed within said cylinder head, said at least one intake valve spaced apart from said recirculation chamber; and a flow control system, said flow control system having an inlet flow position and an outlet flow position, said flow control system interposed said at least one orifice and said at least one recirculation chamber.

10. The engine of claim 9 wherein said flow control system has a flow control mechanism defining said inlet flow position, a closed position and said outlet flow position.

11. The engine of claim 9 wherein said flow control system has a first flow control mechanism and a second flow control mechanism, said first flow control mechanism defining said inlet flow position and a closed position, and said second flow control mechanism defining said outlet flow position and a closed position.

12. The engine of claim 9 wherein said at least one recirculation chamber is located within said body of said cylinder head.

13. The engine of claim 9 wherein at least a portion of said at least one recirculation chamber is positioned externally of said body of said cylinder head.

14. The engine of claim 13 wherein said body has a first bore and a second bore, said second bore being spaced from said first bore;

at least a portion of said recirculation chamber is positioned within a tubular member, said tubular member containing a fluid, said tubular member having a first end portion and a second end portion, said first end portion positioned such that said fluid is in fluid communication with said first bore, said second end portion positioned such that said fluid is in fluid communication with said second bore;

said flow control system has a first flow control mechanism interposed said first orifice and said first end portion; and said flow control system has a second flow control mechanism interposed said second orifice and said second end portion.

15. The engine of claim 9 wherein said chamber has a plurality of volumes.

16. The engine of claim 9 wherein said engine is a homogeneous charge compression ignition engine.

17. An engine, said engine comprising:

a block, said block having at least one cylinder bore, said cylinder bore containing a cylinder liner;

a cylinder head connected to said block, said cylinder head having a body;

at least one piston slideably positioned within said cylinder liner;

at least one combustion chamber, said at least one combustion chamber defined by said body of said cylinder head, said at least one piston, and said cylinder liner, said at least one combustion chamber containing a pressurized fluid;

means for recirculating a portion of said pressurized fluid within said engine, said portion of said pressurized fluid being transferred from said at least one combustion chamber when said pressurized fluid has a first predetermined pressure value, and said portion of said pressurized fluid being transferred to said at least one combustion chamber when said pressurized fluid in said at least one combustion chamber is equal to a second predetermined pressure value, said second pressure value being at least as large as said first pressure value; and an intake valve disposed within said body of said cylinder head, said intake valve being separate from said means for recirculating.

18. A method of operating an engine, said engine having at least one recirculation chamber and at least one combustion chamber, said at least one combustion chamber being in fluid communication with said at least one recirculation chamber, said at least one combustion chamber containing a pressurized fluid, said method comprising:

transferring a portion of said pressurized fluid from said at least one combustion chamber into said at least one recirculation chamber when said pressurized fluid in said at least one combustion chamber reaches a first predetermined pressure value; and transferring said portion of said pressurized fluid from said at least one recirculation chamber to said at least one combustion chamber when said pressurized fluid in said at least one combustion chamber reaches a second predetermined pressure value, said first predetermined pressure value being greater than or equal to said second predetermined pressure value.

19. The method of claim 18 including the method of storing said portion of said pressurized fluid in said at least one recirculation chamber when the pressure of said pressurized fluid in said at least one combustion chamber is between said first pressure value and said second pressure value.

20. The method of claim 18 wherein said engine has a first flow control mechanism interposed said at least one recirculation chamber and said at least one combustion chamber, said first flow control mechanism having an inlet flow position and a closed position, and said method of transferring a portion of said pressurized fluid from said at least one combustion chamber into said at least one recirculation chamber includes placing said first flow control mechanism in said inlet flow position.

21. The method of claim 18 wherein said engine has a second flow control mechanism interposed said at least one recirculation chamber and said at least one combustion chamber, said second flow control mechanism having an outlet flow position and a closed position, and said method of transferring said pressurized fluid from said at least one recirculation chamber to said at least one combustion chamber includes placing said second flow control mechanism in said outlet flow position.

22. The method of claim 18 including the method of measuring pressure of said pressurized fluid in said at least one combustion chamber.

23. The method of claim 18 wherein at least a portion of said at least one recirculation chamber is disposed in a cylinder head of said engine.

* * * * *